US010141008B1

(12) United States Patent
Marsh et al.

(10) Patent No.: US 10,141,008 B1
(45) **Date of Patent: *Nov. 27, 2018**

(54) REAL-TIME VOICE MASKING IN A COMPUTER NETWORK

(71) Applicant: Interviewing.io, Inc., San Francisco, CA (US)

(72) Inventors: Andrew Tatanka Marsh, San Francisco, CA (US); Steven Young Yi, San Francisco, CA (US)

(73) Assignee: Interviewing.io, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/905,437

(22) Filed: Feb. 26, 2018

Related U.S. Application Data

(63) Continuation of application No. 15/409,400, filed on Jan. 18, 2017, now Pat. No. 9,947,341.

(60) Provisional application No. 62/280,426, filed on Jan. 19, 2016.

(51) Int. Cl.

| | |
|---|---|
| ***G10L 25/24*** | (2013.01) |
| ***G10L 21/038*** | (2013.01) |
| ***G10L 25/18*** | (2013.01) |
| ***G10L 21/007*** | (2013.01) |

(52) U.S. Cl.
CPC ..... *G10L 25/24* (2013.01); *G10L 21/007* (2013.01); *G10L 21/038* (2013.01); *G10L 25/18* (2013.01)

(58) Field of Classification Search
CPC ..... G10L 21/0232
USPC ..... 704/205, 264, 500
See application file for complete search history.

(56) References Cited

U.S. PATENT DOCUMENTS

2012/0265534 A1* 10/2012 Coorman ..... G10L 13/033 704/265
2014/0108020 A1* 4/2014 Sharma ..... G10L 19/018 704/500

OTHER PUBLICATIONS

Tang, Min et al., "Voice Transformations: From Speech Synthesis to Mammalian Vocalizations," *Eurospeech* 2001, Sep. 3-7, 2001, 5 pages.
Peterson, Gordon E., et al., "Control Methods Used in a Study of the Vowels," *The Journal of the Acoustical Society of America*, vol. 24, No. 2, Mar. 1952, pp. 175-184.
Caetano, Marcelo and Xavier Rodet, "Improved Estimation of the Amplitude Envelope of Time-Domain Signals Using True Envelope Cepstral Smoothing," *IEEE*, 2011, pp. 4244-4247.
John Wiley & Sons, Ltd, Udo Zölzer, *DAFX Digital Audio Effects*, West Sussex, England, Copyright 2002, pp. 1-553.
Flanagan, J.L. and R.M. Golden, "Phase Vocoder," *The Bell System Technical Journal*, Nov. 1966, pp. 1493-1509.
Bernsee, Stephan, "Pitch Shifting Using the Fourier Transform," *Stephan Bernsee's Blog*, Jan. 17, 2017, pp. 1-21.

(Continued)

*Primary Examiner* — Jakieda R Jackson
(74) *Attorney, Agent, or Firm* — Knobbe, Martens, Olson & Bear, LLP

(57) ABSTRACT

A voice signal may be adjusted to mask traits such as the gender of a speaker by separating source and filter components of a voice signal using cepstral analysis, adjusting the components based on pitch and formant parameters, and synthesizing a modified signal. Features are disclosed to support real-time voice masking in a computer network by limiting computational complexity and reducing delays in processing and transmission while maintaining signal quality.

20 Claims, 7 Drawing Sheets

(56) References Cited

OTHER PUBLICATIONS

Robel, A. and X. Rodet, "Efficient Spectral Envelope Estimation and its Application to Pitch Shifting and Envelope Preservation," *Proc. of the 8th Int. Conference on Digital Audio Effects* (*DAFx'05*), Madrid, Spain, Sep. 20-22, 2005, pp. 1-6.
Puckette, Miller, "Phase-locked Vocoder," Proceedings, 1995 IEEE ASSP Conference on Applications of Signal Processing to Audio and Acoustics (Mohonk, N.Y.), 1995, 4 pp.
Laroche, Jean and Mark Dolson, "New Phase-Vocoder Techniques for Pitch-Shifting, Harmonizing and Other Exotic Effects," *Proc. 1999 IEEE Workshop on Applications of Signal Processing to Audio and Acoustics*, New Palz, New York, Oct. 17-20, 1999, pp. 91-94.
Dolson, Mark, "The Phase Vocoder: A Tutorial," Computer Music Journal, vol. 10, No. 4 (Winter, 1986), The *MIT Press*, Nov. 19, 2008, pp. 14-27.

* cited by examiner

REAL-TIME VOICE MASKING IN A COMPUTER NETWORK

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

An audio signal representing speech may convey information allowing a listener to identify certain characteristics about the speaker. For example, male speakers are commonly associated with lower pitched voices than female speakers. Similarly, some listeners may draw inferences about a speaker's race, age, emotional state or physical attractiveness from listening to an audio signal representing their voice. In certain situations, it may be desirable to prevent the listener from drawing such inferences. For example, when a recruiter listens to a prospective applicant speaking through a voice connection, it may increase the objectivity of the process if the recruiter is prevented from forming conclusions based on characteristics of the applicant's voice.

Because such inferences may be drawn on a subconscious level by some listeners, it may be difficult for those listeners to refrain from drawing such inferences even when the listener consciously wishes to do so. Accordingly, a system that prevents the listener from drawing such inferences without significantly impeding the effective verbal communication between the speaker and the listener is desirable.

While techniques for adjusting pitch without affecting the duration of a signal are well known, simple pitch shifting provides poor results for voice masking because certain patterns that human listeners rely on to understand the speech content of the signal may be disrupted.

Source-Filter Model

Without being limited by theory, it is believed that the sound of a speaker's voice is significantly determined by resonances of one fundamental frequency that is produced in the speaker's larynx. A variation of this fundamental frequency is generally perceived as change of pitch in the voice. The fundamental and resonant frequencies produced in the larynx are filtered by the speaker's vocal tract. Depending on the spoken phoneme, the speaker's vocal tract will emphasize some frequencies and attenuate others.

The human vocal system may thus be conceptualized using a source-filter model, wherein the source corresponds to the larynx and the filter corresponds to the vocal tract. The frequencies which are most strongly emphasized by the vocal tract during a particular period of vocalization are referred to as formant frequencies. When the vocal tract is viewed as a filter, these formant frequencies may be considered the peaks of the filter's transmission function.

The fundamental frequency of a human's larynx varies individually, and is correlated with the speaker's age, sex, and possibly with other characteristics. The formant frequencies and, more generally, the shape of the vocal tract's transmission function are believed to vary depending both on the spoken phoneme and individual characteristics of the speaker. Accordingly, both the fundamental frequency and the formant frequencies convey information about certain attributes of the speaker, and are interpreted by listeners accordingly.

One empirical study found that a typical male speaker speaking the sound "u", as pronounced in "soot" or "tomb", would exhibit a fundamental frequency of 141 Hz, with formants at 300 Hz, 870 Hz and 2240 Hz, respectively. Conversely, a typical female speaker pronouncing the same phoneme would have a fundamental frequency of 231 Hz, with formant frequencies at 370 Hz, 950 Hz, and 2670 Hz. A child pronouncing the same phoneme would have yet another different set of typical fundamental and formant frequencies. Peterson, et al., *Control Methods Used in a Study of the Vowels*, Journal of the Acoustical Society of America, Vol. 24, No. 2 (1952).

To transform a signal representing one speaker's voice into a signal with characteristics approximating a different speaker's voice, various methods have been proposed to adjust both the pitch (corresponding to the fundamental frequency of the source) and the formant frequencies (corresponding to the peaks of the filter's transmission function). E.g., Tang, *Voice Transformations: From Speech Synthesis To Mammalian Vocalizations,* EUROSPEECH 2001 (Aalborg, Denmark, Sep. 3-7, 2001). Some of these methods determine approximations of the source and filter components of a recorded voice signal, separately adjust them, and reconvolve them. For example, according to Tang, vocal source and vocal filter can be modelled as a convolution in the time domain representation of a recorded signal, which is equivalent to a multiplication in the frequency domain. By converting the signal into a frequency-domain representation using a discrete Fourier transform, and then converting the frequency-domain representation to polar coordinates, a magnitude spectrum can be determined. By then determining an envelope of the magnitude spectrum and dividing the magnitude spectrum by its envelope, an "excitation spectrum", which can be viewed as an approximation of the source spectrum in the source-filter model, can be determined. Tang's approach is one of many frequency domain voice transformation techniques that rely on the basic "Phase Vocoder." See Flanagan et al., *Phase Vocoder*, Bell System Technical Journal, November 1966.

Other literature has recognized that the use of discrete Fourier analysis and subsequent Fourier synthesis in the context of processing audible signals may require steps to compensate for the inherent discretization artifacts introduced by the methods. Specifically, Fourier analysis may introduce "frequency smearing"—discretization errors that occur when the signal includes frequencies that do not fully align with any frequency bin. This may lead to a number of effects undesirable in the context of audio processing, including, for example, interference effects between adjacent channels. The literature has also recognized that these effects can be reduced by appropriately relating the phase of the signal to the frequency of the frequency bin. Puckette describes the sound resulting from interference between adjacent frequency bins as "reverberant" and proposes a technique described as "phase locking", or modifying the phase of the reconstructed signal so as to maximize the difference in phase between adjacent frequencies. Puckette, *Phase-locked Vocoder*, Proceedings of the 1995 IEEE ASSP Conference on Applications of Signal Processing to Audio and Acoustics (Mohonk, N.Y., Oct. 15-18, 1995).

Various methods have been proposed to determine the magnitude spectral envelope that is used when separating source and filter components of an input signal as described above. Tang suggests simple low-pass filtering. Robel suggests that it may be desirable to use alternative methods that give a more accurate representation of the spectral envelope. Robel et al., *Efficient Spectral Envelope Estimation and Its*

*Application to Pitch Shifting and Envelope Preservation*, Proceedings of the Eighth International Conference on Digital Audio Effects (Madrid, Spain, Sep. 20-22, 2005). Robel specifically identifies a discrete cepstrum method and a true envelope method. According to Robel, the discrete cepstrum method may require extrinsic knowledge of the fundamental frequency. This may make utilizing the proposed method difficult for a system that is to be compatible with multiple users, since the fundamental frequency varies with the speaker's anatomy, and thus additional steps would have to be performed to determine the fundamental frequency before processing can be performed. The true envelope method does not require such knowledge but, as proposed, is an iterative algorithm that requires a Fourier analysis and a Fourier synthesis in each iteration.

Robel relies on a cepstrum, which is a Fourier transformation applied to the log of a spectrum. By analyzing the cepstrum, it is possible to separate out the effects of fundamental frequency and its harmonics generated by the larynx and the filtering from the vocal tract. Such separation may be explained by harmonic peaks in the acoustic spectrum emitted by the larynx being spaced closely compared to the peaks of the vocal tract's transmission function. Accordingly, peaks in the low-frequency range of the cepstrum can be attributed to filtering by the vocal tract, and peaks in the high-frequency range can be attributed to the source signal from the larynx.

Robel specifically discusses applying various types of filtering to the cepstrum, and explains that if the cepstrum from the recorded signal is subjected to low-pass filtering, it will approximate the cepstrum of the spectral envelope, and thus the cepstrum of the transmission function of the vocal tract. However, Robel also identifies problems related to inaccuracies introduced when using the low-pass filtered cepstrum to determine the spectral envelope. Robel therefore proposes an algorithm that, by iteratively refining the low-pass filtered cepstrum, may provide a better representation of the spectral envelope. But as Robel acknowledges, the proposed method requires "rather extensive computation, particularly where the FFT size is large". This may make the proposed method difficult to implement as a real-time system, particularly on hardware with modest computational resources.

The techniques described above provide useful tools for voice transformation, but they are subject to constraints that may limit their utility for certain potential use cases. For example, it may be useful to provide high-quality voice masking in real-time communications over the Internet or other computer networks for purposes such as reducing bias when recruiting employees, as noted earlier. However, the literature described above does not address the implementation challenges that interfere with such use cases. Thus, there is a need for improvements that overcome those challenges.

SUMMARY

For use in real-time processing, particularly where the voice masking is applied to one or both sides of a bidirectional voice conversation, it may be desirable to reduce or limit the average and/or maximum delay introduced by the voice masking. This may be accomplished, for example, by reducing the length of audio being buffered before being processed by the algorithm, and by reducing the execution time of the voice masking algorithm as described below.

Real-time voice masking also requires that the transformation and the transmission of the voice signal take place while the speaker is talking, and thus without the entire signal being available at the time of processing, thereby avoiding delays that would prevent fluid conversation. This may be referred to as "on-line" processing, as opposed to "off-line" processing wherein the entire signal is available before processing begins.

As discussed above, voice masking may be accomplished by separating the source and filter components of a recorded voice signal, separately adjusting them, and transforming them back into an audible signal. For example, an embodiment may generate an output signal with the same fundamental frequency, but filtered by a different vocal tract configuration, or an output signal filtered with the same vocal tract configuration, but a different fundamental frequency.

To adjust the pitch frequency, corresponding to a change in the speaker's fundamental frequency without a corresponding change in the speaker's vocal tract, the source's excitation spectrum can be linearly rescaled on the frequency axis. To adjust the formant frequency without substantially affecting the pitch, the filter's transmission function can be linearly rescaled on the frequency axis. To adjust the pitch frequency and formant frequency simultaneously, the source's excitation spectrum and the filter's transmission function can both be linearly rescaled on the frequency axis, by the same or by different amounts.

The previously discussed cepstral techniques for pitch and formant adjustment, implemented as modifications to a Phase Vocoder, can be performed continuously on a series of successive signal segments (or windows) to provide voice transformation in real-time communication systems. The processing needed to perform the transformation introduces a delay in the communication link that the transformation is applied to, but the processing delay can be reduced by shortening the duration of individual signal segments. If signal segments are too short, however, more processing artifacts are introduced and the quality of the synthesized output is diminished. To improve the quality of the synthesized output while limiting the communication delay, overlapping signal segments may be used. Further improvements in quality may be obtained by performing phase locking across discrete frequency bins within a signal segment. As noted above, Puckette teaches a phase locking technique for reducing reverberant distortion. Such distortion may be exacerbated when formant adjustment is applied to a signal in addition to or instead of pitch adjustment. When phase-locking is applied in the context of combined pitch and formant adjustment, distortion may be reduced to a greater than expected degree.

Voice masking may be implemented in a network-based communication system, which in some embodiments involves one or more servers that coordinate communications between multiple clients. Signal segments may be transformed at client computers before they are transmitted over the network (or across multiple networks), which advantageously prevents excessive computational load on the servers and spreads the load across multiple clients. Such client-side processing also limits network congestion and transmission delays. However, the computational resources of client computers may be limited. To reduce the computational load on the client computers, a limit may be placed on the number of iterations used for true envelope estimation on each signal segment. In some embodiments, one or more servers provide instructions that control the signal processing at client computers, but the servers may not handle the transmitting or receiving of signal segments—for example, because the client computers communicate with each other directly. In various embodiments, the client computers are computing devices such as laptop computers, desktop computers, tablet computers, or smartphones.

Figure 1:
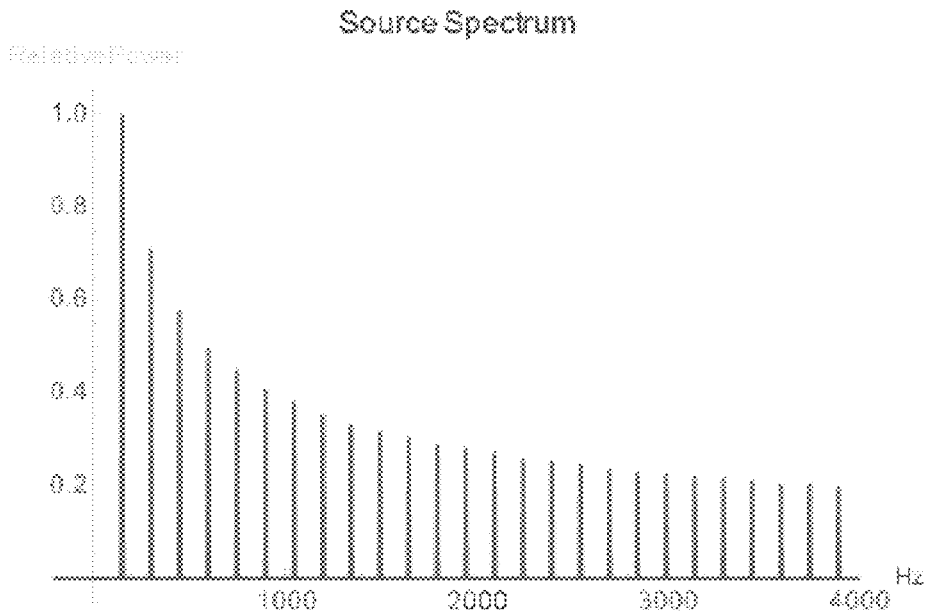
FIG. 1 shows an illustrative example of a frequency domain representation of a signal as might be generated by a human larynx.

The drawings are provided to illustrate example embodiments and are not intended to limit the scope of the disclosure.

DETAILED DESCRIPTION

Reference will now be made to the drawings, in which like reference numerals refer to like parts throughout.

Signal Transformations

Figure 2:
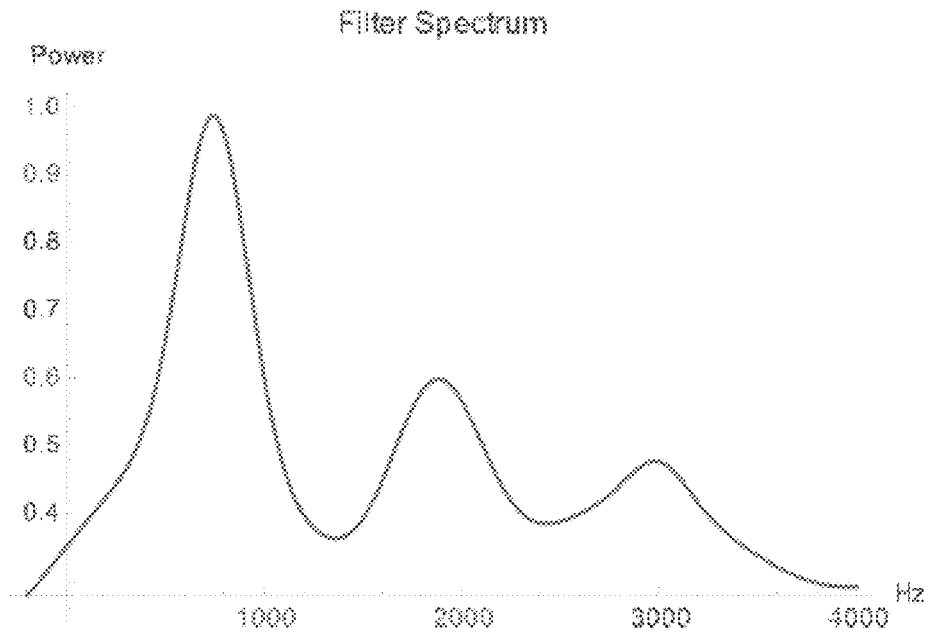
FIG. 2 shows an illustrative example of a transmission function of a human vocal tract.
Figure 3:
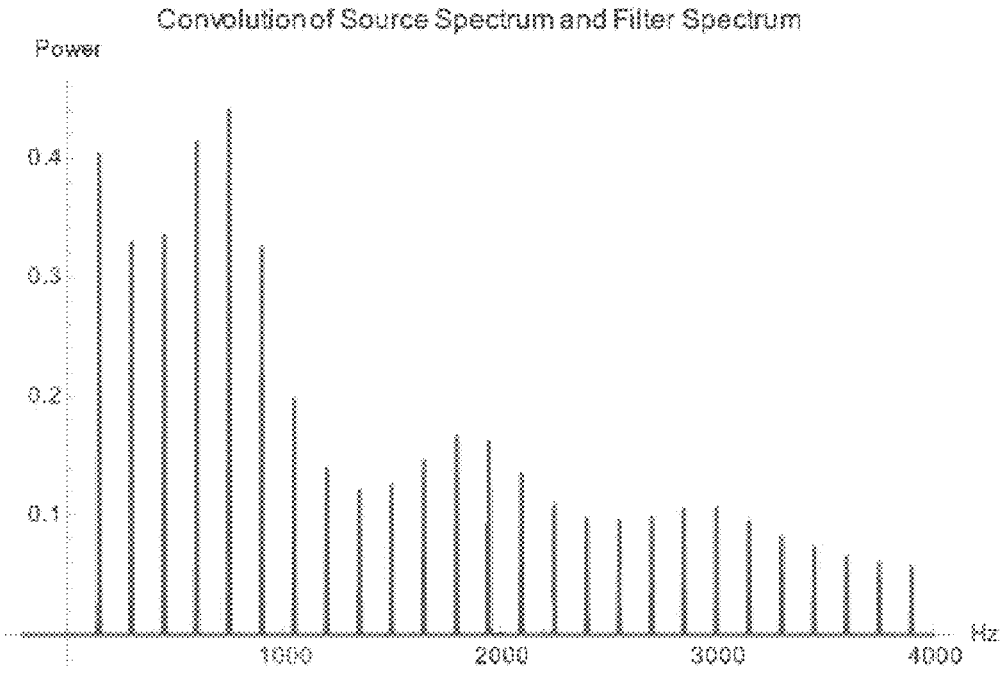
FIG. 3 shows a convolution of the spectra in FIGS. 1 and 2.

FIGS. 1, 2 and 3 illustrate the source-filter model described above. The human larynx acts as the source of a signal, an example spectrum of which is illustrated in FIG. 1. The example spectrum is based on a fundamental frequency of 150 Hz (a fundamental frequency that may be attributed to a male speaker). The example spectrum features harmonics at integer multiples of this fundamental frequency. The spacing between two adjacent harmonics is thus 150 Hz.

The human vocal tract acts as a filter, an example spectrum of which is illustrated in FIG. 2. The peaks of this spectrum are described as the formants. The spacing between two adjacent formants varies, but is approximately 1000 Hz in FIG. 2.

FIG. 3 illustrates the spectrum of the sound that would be produced when the source shown in FIG. 1 is filtered by the filter shown in FIG. 2, as would occur in human speech when the fundamental frequency and harmonics produced in the larynx are filtered by the vocal tract. Mathematically, the spectrum of FIG. 3 is produced from the convolution of the source spectrum and filter spectrum.

Figure 4:
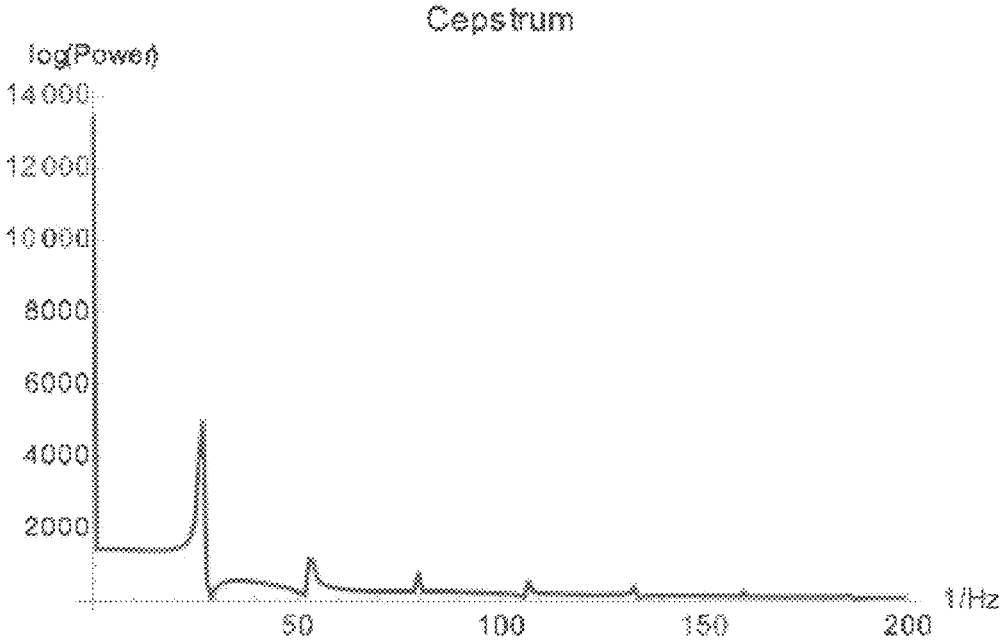
FIG. 4 shows part of the cepstrum calculated from the signal shown in FIG. 3.

FIG. 4 illustrates a cepstrum for the speech signal, which is calculated by discretization of, taking the logarithm of, and application of the Fast Fourier Transform to, the speech spectrum in FIG. 3. The resulting speech cepstrum can be understood as the sum of two underlying cepstra: one calculated from the source spectrum shown in FIG. 1 and one calculated from the filter spectrum shown in FIG. 2.

Figure 5:
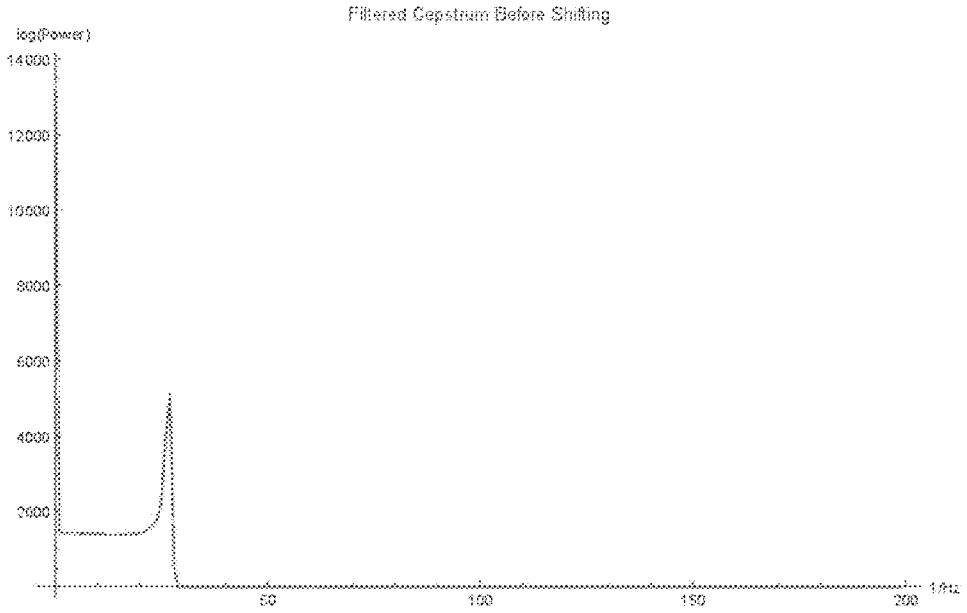
FIG. 5 shows a low-pass filtered cepstrum.
Figure 7:
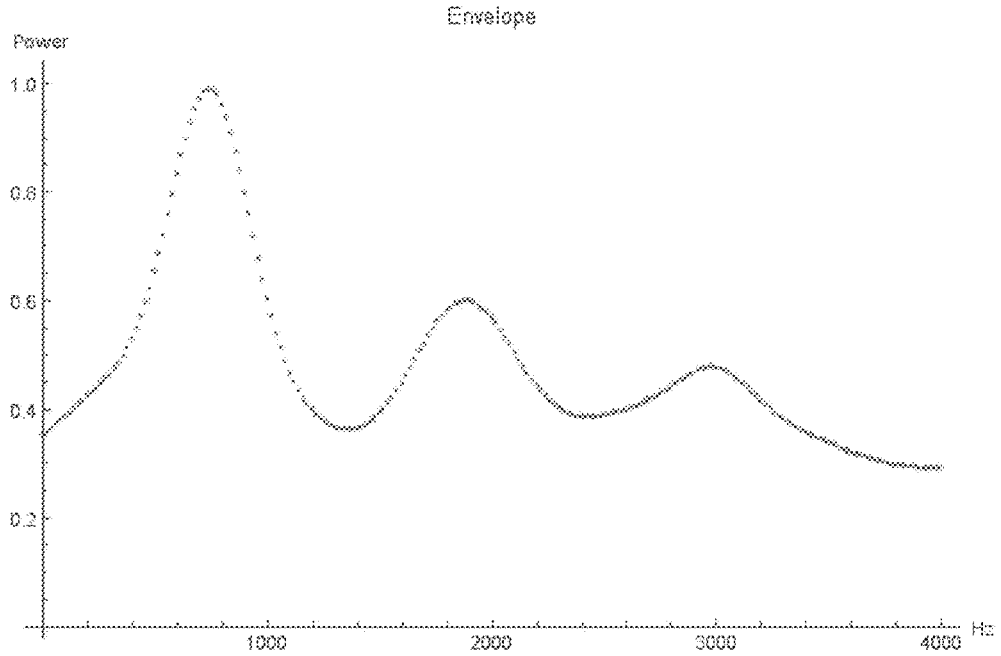
FIG. 7 shows a magnitude spectral envelope that approximates the spectrum in FIG. 2.

FIG. 5 shows a filtered version the speech cepstrum from FIG. 4. This filtered cepstrum is generated, for example, by low-pass filtering the speech cepstrum, which may be accomplished by setting to zero all coefficients above a certain cut-off threshold. The filtered cepstrum of FIG. 5 approximates the result that would be obtained by taking the cepstrum of the filter function in FIG. 2. Accordingly, an approximation of FIG. 2's filter function can be obtained by converting the filtered cepstrum of FIG. 5 back into the frequency domain. This resulting approximation may be referred to as the magnitude spectral envelope, an example of which is shown in FIG. 7.

Figure 6:
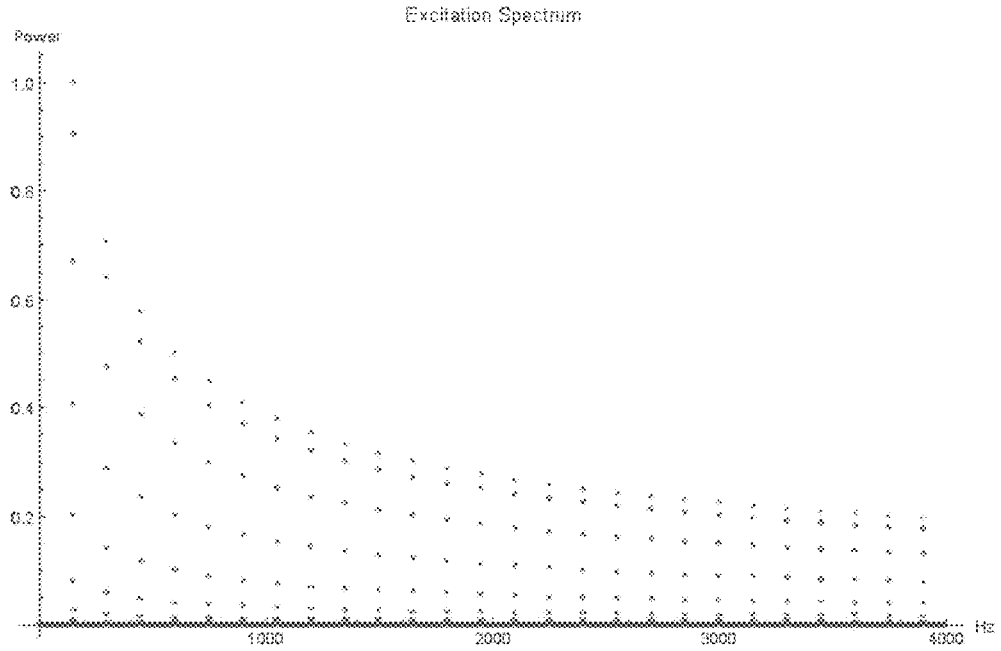
FIG. 6 shows an excitation spectrum that approximates the spectrum in FIG. 1.

Because the frequency-domain representation of the original speech signal can be viewed as the product of the source function and the filter function, dividing the speech signal by an approximation of the original filter function will yield an approximation of the spectrum of the source function. The result of this operation is referred to as the excitation spectrum. FIG. 6 illustrates an excitation spectrum that approximates the spectrum in FIG. 1.

Formant adjustment can be performed by linearly rescaling the magnitude spectral envelope (which approximates the original signal's filter function) on the frequency axis. Multiplying the modified spectral envelope with the excitation spectrum then yields the spectrum of the formant-adjusted signal. In addition, rescaling (e.g., linear rescaling) may be applied to the excitation spectrum to accomplish pitch adjustment Advantageously, rescaling of the excitation spectrum and magnitude spectral envelope may be integrated before re-convolving the spectra to form an output signal, avoiding unnecessary calculation of intermediate results. The adjusted signal can be transformed back into the time domain and played back.

Processing Signal Data

Implementation of the signal transformations described above requires data processing infrastructure that is adapted for the purpose of voice masking. An example of such infrastructure is described below, along with optimizations that allow the processing to be accomplished in real time.

Some of the figures discussed below are flow diagrams. These should be understood to illustrate a possible arrangement of steps in the execution of a program and need not necessarily coincide with the signal flow. For example, a block may have access to information determined in all preceding blocks, not just the immediately preceding block.

Figure 8:
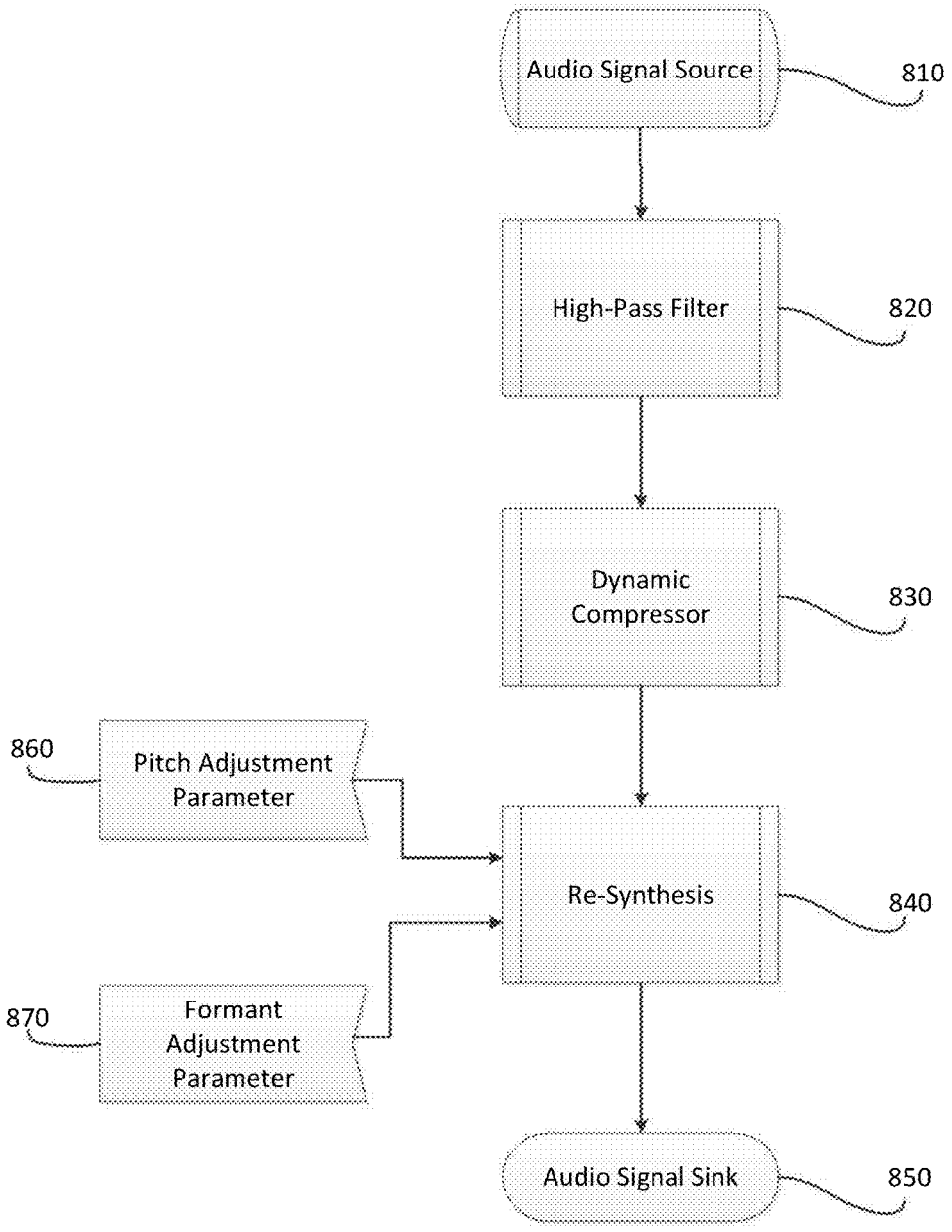
FIG. 8 is a flow diagram depicting a routine for real-time voice changing, according to one embodiment.

FIG. 8 illustrates an example processing path for a signal. The audio source 810, in some embodiments, may be real-time sound input, such as from a microphone or from a stream received over a computer network. In some embodiments, the audio source may be non-real time input, such as an MP3 file or a WAV file. In some embodiments, the input is converted to a fixed sample rate. In one embodiment, the input is read from a WAV file from a computer's local hard disk at a sample rate of 44,100 Hz.

The quality of the results after re-synthesis may be sensitive to the quality of the input audio. Specifically, input signals with certain characteristics, such as high dynamic range, or the presence of frequencies low in the audible range, may lead to distorted, clipped or otherwise below-optimal output after re-synthesis. Accordingly, in some embodiments, one or more filters are applied to the audio signal before that signal is fed into the re-synthesis block. For example, the audio signal may be filtered by compressing the dynamic range or by attenuating low frequencies using a high-pass filter.

With continued reference to FIG. 8, the input signal acquired from the audio source 810 may first be processed by a high-pass filter 820. In some embodiments, the high-pass filter 820 may be implemented using analog circuitry. Alternatively, the high-pass filter may be implemented using digital signal processing, for example by using a Fourier transformation, filtering in the frequency domain, and Fourier synthesis. In an example embodiment, the high-pass filter is implemented in software, using the Web Audio API (published by the World Wide Web Consortium, https://www.w3.org/), with a biquadratic filter function.

With continued reference to FIG. 8, a dynamic compressor operates on the output of the high-pass filter 820. In some embodiments, the dynamic compressor 830 may be implemented using analog circuitry. Alternatively, the dynamic compressor 830 may be implemented using digital signal processing. This can be accomplished by first estimating a spectral envelope function of the signal, for example by low-pass filtering it. By comparing the value of the envelope function with a reference value that represents a desired compressed envelope, a gain factor can be determined that scales the signal to match the desired compressed envelope. The signal can then be compressed by multiplying the signal in its time-domain representation with the determined gain factor. In an example embodiment, the compressor is implemented in software, using the Web Audio API with a compressor function.

Figure 9:
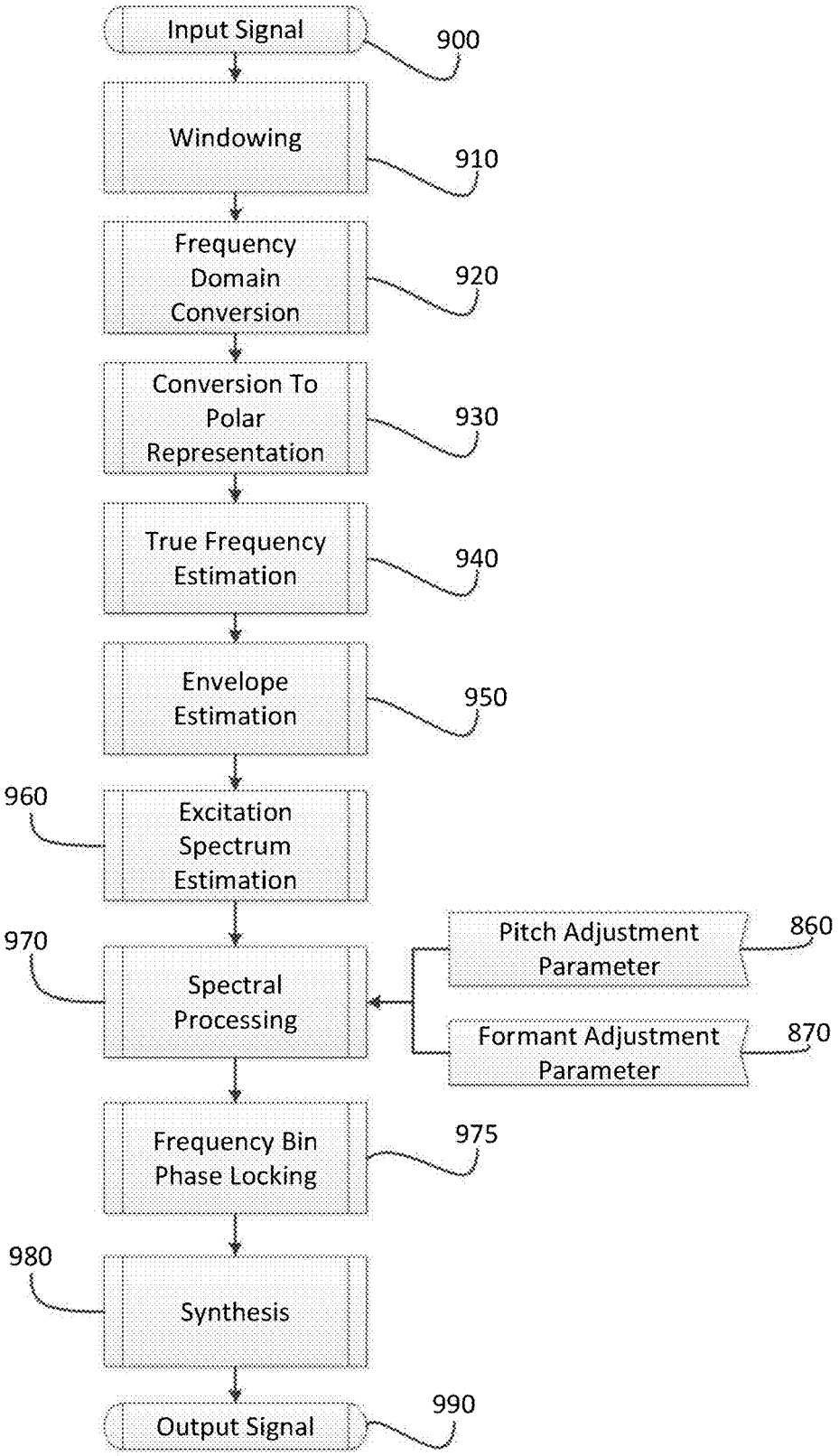
FIG. 9 is a flow diagram showing an re-synthesis subroutine, according to an embodiment.

With continued reference to FIG. 8, the re-synthesis block 840 operates on the output of the dynamic compressor 830. The re-synthesis block performs an adjustment of the signal's pitch and formant frequencies in order to reduce the information about the speaker that these characteristics would convey to a listener, without significantly reducing the comprehensibility of spoken language. The re-synthesis block 840 may be implemented using a software subroutine, for example as shown in FIG. 9. In some embodiments, the re-synthesis block 840 may permit a user, administrator, or service provider to specify pitch adjustment parameter 860 and formant adjustment parameter 870.

With continued reference to FIG. 8, the audio sink 850 operates on the output of the re-synthesis block 840. In some embodiments, the audio sink 850 may be real-time sound output, such as to a speaker or a phone. For example, the audio sink 850 may be implemented by a network interface and corresponding software that transmits the audio signal over a computer network, such as the Internet. The audio sink 850 may also be non-real time sound output, such as output to an MP3 file or WAV file. In an example embodiment, the output is converted to a compressed representation, for example using the Speex codec, and sent out through a computer's network interface to the computer of a remote party, where it may be played back. When the audio is transferred over a network, it may be advantageous to utilize an appropriately sized transmit buffer within audio sink 850 that is sufficiently large to allow for appropriate throughput, but sufficiently small to avoid introducing undue latency. For example, audio sink 850 may comprise a 1 ms, 5 ms, 10 ms, or 50 ms transmit buffer.

FIG. 9 illustrates an example of a sequence of steps for re-synthesis of a signal as performed by the re-synthesis block 840 of FIG. 8. The input signal 900 may correspond to the output of dynamic compressor 830 from FIG. 8. In a windowing step 910, the input signal 900 is subdivided into segments. Such windowing may be performed by multiplying the input signal in the time domain with a suitable windowing function. To reduce the introduction of artifacts in the output signal due to windowing and to make the numerical calculations more stable, the width of each segment may be chosen so that multiple segments overlap. In one embodiment, the windowing step 910 is performed using the Hanning window function, and the width of each segment is chosen so that two adjacent windows have an overlap of about 94% and so that one window contains approximately 40 ms of signal.

With continued reference to FIG. 9, each segment from the windowing step 910 is then converted into a frequency-domain representation in step 920. In some embodiments, frequency domain conversion step 920 is performed sequentially on all segments, starting at the beginning. The frequency domain conversion step 920 may be implemented using a Fast Fourier Transform algorithm, for example. In one embodiment, such conversion is performed by an open-source software library from "Project Nayuki" (available at https://www.nayuki.io/page/free-small-fft-in-multiple-languages). In an example embodiment, the chosen size of the Fast Fourier Transformation is 2048. Advantageously, a power of two is chosen, allowing in some embodiments for the use of simpler algorithms.

It will be appreciated that care must be taken to either use a symmetric definition of the Fourier transform, or appropriately choose "forward" and "inverse" Fourier transformation in the implementation of the algorithm. In some embodiments, a symmetric definition of the Fourier transformation may be used, thus making it less important to distinguish between "forward" and "inverse" Fourier transformation.

With continued reference to FIG. 9, the frequency-domain representation from step 920 is processed in step 930, to convert the frequency-domain representation into polar coordinates, yielding phase and magnitude components for each bin of the discrete signal representation. The signal representation created in step 930 is then further processed in a true frequency estimation step 940, which may make the frequency estimate in each bin of the currently processed signal segment more accurate than it would be if the estimate was determined solely from the frequency domain conversion step 920. In some embodiments, the true frequency estimation step 940 utilizes a phase unwrapping technique based on the phase information determined from the current and one or more previously processed signal segments.

The frequencies estimated in the true frequency estimation step 940 and the phase and magnitude information calculated in the conversion to polar representation step 930 are passed to an envelope estimation step 950. This step calculates the magnitude spectral envelope of the signal, which approximates the filter spectrum of a speaker's vocal tract. Examples of a filter spectrum and a corresponding magnitude spectral envelope are shown in FIG. 2 and FIG. 7, respectively.

Various techniques to calculate the magnitude spectral envelope of a signal are described in Caetano et al., *Improved Estimation of the Amplitude Envelope Of Time-Domain Signals Using True Envelope Cepstral Smoothing*, IEEE International Conference on Acoustics, Speech, and Signal Processing (2011). In some embodiments, the magnitude spectral envelope may be determined by calculating a cepstrum using a Fourier transformation, low-pass filtering the cepstrum, and transforming the cepstrum back into a spectrum by using another Fourier transformation. Low-pass filtering can be implemented by calculating the cepstrum and discarding a number of the highest Fourier coefficients of the cepstrum. For example, the upper 40%, 60% or 80% or coefficients may be set to zero. In an example embodiment, a Fast Fourier Transformation size of 2048 is chosen, and only the lowest 40 Fourier coefficients are kept, with all higher coefficients set to zero.

In some embodiments, the magnitude spectral envelope is determined by true envelope estimation, in which low-pass filtering is performed in conjunction with iterative smoothing; this is discussed below with reference to FIG. 10.

With continued reference to FIG. 9, the magnitude information calculated in the conversion to polar representation step 930 and the magnitude spectral envelope estimated in step 950 are passed to the excitation spectrum estimation step 960. In excitation spectrum estimation step 960, the magnitudes calculated in conversion to polar representation step 930 are divided by the magnitudes of the magnitude spectral envelope estimated in step 950. The result of this calculation is the excitation spectrum, and can be viewed as an estimate of the source spectrum of a speaker's larynx. Examples of a source spectrum and a corresponding excitation spectrum are shown in FIGS. 1 and 6.

With continued reference to FIG. 9, in a spectral processing step 970, the signal representation created in the conversion to polar representation step 930 is filtered to obtain a transformed signal with adjusted pitch and formants. The spectral processing step 970 makes use of the magnitude spectral envelope estimated in step 950 and the excitation spectrum estimated in step 960. Thus, the calculation of the transformed signal is implicitly based on the true frequencies obtained in the true frequency estimation step 940. A pitch adjustment parameter 860 and a formant adjustment parameter 870 are specified to determine the amount of pitch change and formant change that should be performed.

In an example embodiment, the spectral processing step 970 is performed by rescaling the excitation spectrum by an amount determined by the pitch adjustment parameter 860, and rescaling the magnitude spectral envelope by an amount determined by the formant adjustment parameter 870. A transformed excitation spectrum is then generated by multiplying the excitation spectrum determined in step 960 with the modified magnitude spectral envelope. Advantageously, this allows independent pitch and formant adjustment in a single step, and accommodates any combination of desired formant or pitch adjustment.

Because the magnitude spectral envelope and the excitation spectrum may be represented by discrete Fourier coefficients, it may be advantageous to use the frequencies determined in the true frequency estimation step 940 during rescaling to avoid introducing artifacts when rescaled frequencies do not exactly match up with a bin frequency. Spectral components that, after rescaling, would fall outside the frequency ranges that can be represented by the chosen set of discrete Fourier coefficients may be discarded. To preserve overall spectral power, a gain factor corresponding to the power contained in the discarded coefficients may be calculated and applied to the output signal.

In some embodiments, the spectral processing step 970 may alternatively be implemented by linearly rescaling either the magnitude spectral envelope or the excitation spectrum in an amount corresponding to both the desired pitch and formant adjustment, and resampling the output signal in an amount corresponding to the desired pitch adjustment only.

As an example, to increase the formant frequency by seven semitones while leaving the pitch unchanged, the magnitude spectral envelope can be rescaled by a factor of 1.5 so as to move a formant peak previously at 2000 Hz to 3000 Hz, while leaving the excitation spectrum unchanged. To increase the pitch frequency by seven semitones while not separately adjusting the formant frequencies, only the excitation spectrum would be rescaled by a factor of 1.5, thus shifting the frequencies of the excitation spectrum so that when eventually re-convolved with the original magnitude spectral envelope, it will retain the same formant structure. To increase the pitch frequency by seven semitones while decreasing the formant frequencies by seven semitones, the magnitude spectral envelope would be scaled by a factor of 1.5 while the excitation spectrum would be rescaled by a factor of ⅔.

When performing the rescaling, a situation may arise in which no single frequency bin after rescaling corresponds to a frequency bin before rescaling. For example, when rescaling a spectrum composed of discrete frequency bins, starting at 100 Hz and spaced 20 Hz apart, by 10%, a frequency of 100 Hz may be rescaled to 110 Hz. The rescaled frequency may thus fall right between two frequency bins. Conversely, one output bin may correspond to several input bins. In some embodiments, these discretization problems may be resolved by using the "nearest neighbor" frequency bin, but only assigning the new magnitude value if it is higher than the existing value in that bin. This may better preserve smoothness and acoustic fidelity. In other embodiments, each output bin value may be determined by summing all contributions from the individual input bins, or it may be calculated using an average. These approaches may better preserve overall spectral power.

With continued reference to FIG. 9, the output frequencies and magnitudes of the individual segments, as obtained in the spectral processing step 970, are phase-adjusted in a frequency bin phase locking step 975. Frequency bin phase locking step 975 may be implemented by first converting the output from spectral processing step 970 into rectangular coordinates, yielding, for each frequency bin, a complex number. Phase locking can then be implemented by iterating over the frequency bins. Because the frequency bin phase locking aims to change only the phase while leaving the magnitude substantially unchanged, the magnitude is calculated and stored for each frequency bin before making adjustments. The phase can then be adjusted by subtracting, from the complex value corresponding to each frequency bin, the complex values corresponding to its two closest neighbors. In some embodiments, additional weighting may be performed; for example, the two closest neighbors may be scaled by a factor of 0.5 or 2, or another factor. The result can then be divided by its magnitude to yield a unit vector with the desired phase angle. The unit vector can then be multiplied with the stored magnitude, yielding a signal with adjusted phase and unchanged magnitude.

With continued reference to FIG. 9, the output from the frequency bin phase locking step 975 is then converted into time-domain representation and reassembled into a complete time-domain signal in a synthesis step 980. In an example embodiment, the synthesis step 980 is performed by converting the segment into a time-domain signal using the Fast Fourier Transform, multiplying it with a suitable windowing function, such as a Hanning window, and assembling the output signal 990 by adding the signal to an output buffer. This may be described as an "overlap-add" process to the windowed signal.

In some embodiments, the parameters by which the spectral processing step 960 modifies the pitch and formant parameters of the input signal may be dynamically adjustable by a user or automatically. In an example embodiment, the pitch adjustment parameter 860 is configured to increase the pitch by about 12 semitones, and the formant adjustment parameter 870 is configured to increase the formant frequencies by about 3 semitones, to convert a signal of a male voice into a signal comparable to a female voice.

Figure 10:
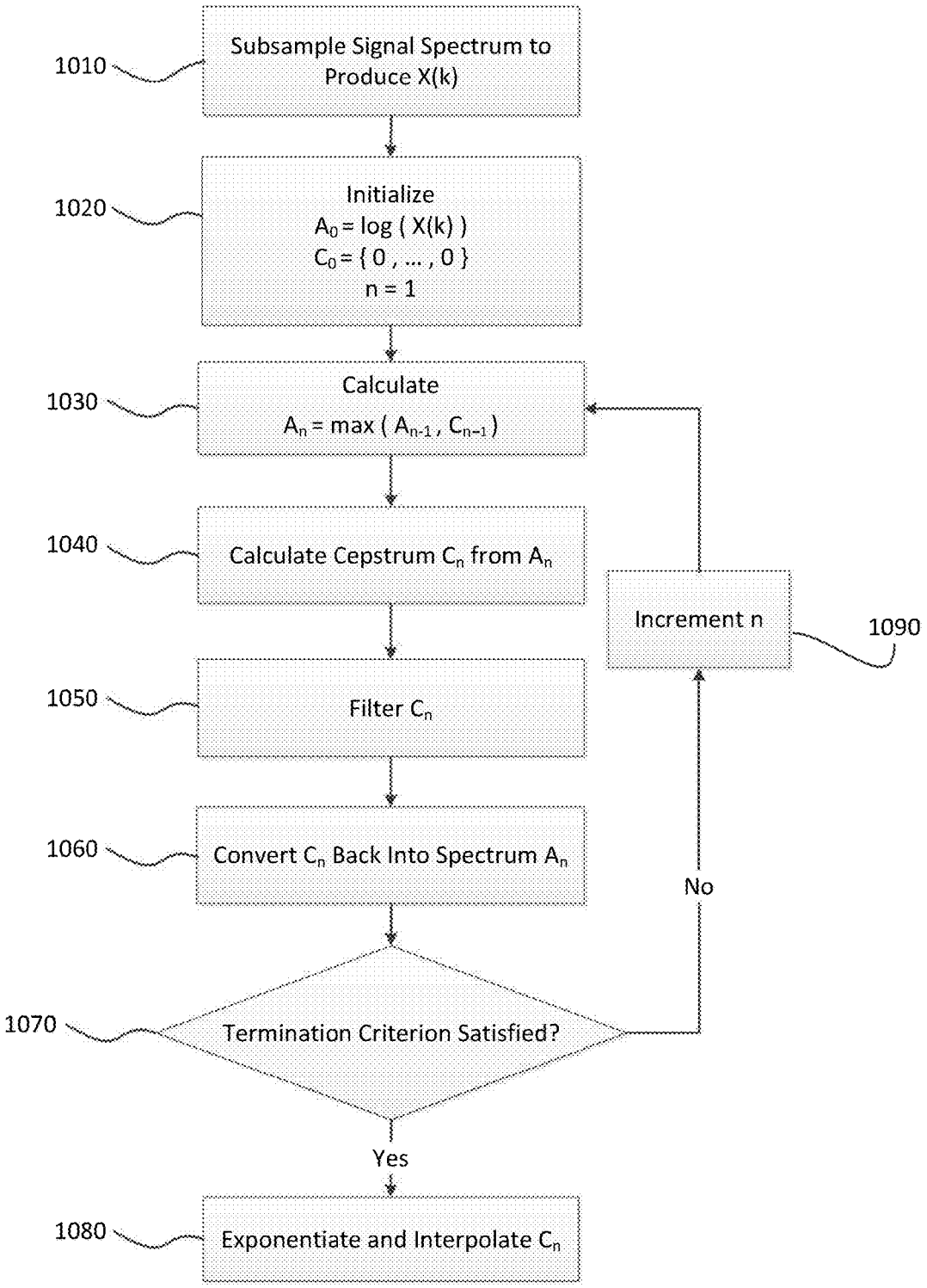
FIG. 10 is a flow diagram depicting a true envelope estimation subroutine, according to an embodiment.

FIG. 10 illustrates an example envelope estimation subroutine using true envelope estimation, which may implement the envelope estimation step 950 illustrated in FIG. 9.

In step 1010, the input signal may optionally be subsampled, or decimated, on the frequency scale to reduce the computational complexity and memory requirements of envelope estimation. For example, the magnitude spectral envelope may be calculated at a frequency resolution that is lower than the signal by a factor of 2, 4, 8 or 16. This may allow significant performance benefits during subsequent steps, for example by making the Fast Fourier Transformation size executed within the iteration step smaller as discussed below. Advantageously, because the magnitude spectral envelope can be expected to, on average, change less rapidly over a given difference in frequency than the signal itself, calculating the magnitude spectral envelope at a lower resolution may be expected to result in low information loss and thus low or no perceivable loss in output quality. When the magnitude spectral envelope is calculated at a lower frequency resolution than the signal, it may be necessary to subsample the signal to the lower frequency resolution before calculating the magnitude spectral envelope, then estimate the magnitude spectral envelope, and finally interpolate the magnitude spectral envelope to the initial resolution of the signal before it is used in subsequent calculation steps. In one embodiment, the magnitude spectral envelope is calculated at a frequency resolution that is lower than the frequency resolution of the signal by a factor of 2.

In step 1020, variables are initialized to prepare for a first iteration. The iteration counter n is initialized with 1 to reflect that this is the first iteration. The spectral envelope $C_0$ is initialized with zero values so as to not have an effect during the first iteration. The spectrum of the signal, as subsampled in step 1010, is referred to as X(k), and $A_0$ is initialized as the natural logarithm of that spectrum, $A_0=\log(X(k))$.

The algorithm then proceeds to step 1030, which may be considered the first step of the iteration. In step 1030, for each frequency bin, the maximum is taken from the signal $A_n(k)$ and the calculated spectral envelope $C_n$. In step 1040, a cepstrum $C_n$ is then calculated from $A_n(k)$ by performing a Fourier transformation on $A_n(k)$. In step 1050, smoothing, such as, for example, low-pass filtering, is applied to the cepstrum $C_n$ calculated in step 1040. In step 1060, the cepstrum $C_n$ is transformed back into the frequency domain by using Fourier transformation. Because $C_0$ may be initialized with all coefficients equal to 0, the maximization step has no effect and may be skipped on the first iteration. In step 1070, a termination criterion is applied to decide whether to perform another iteration. For example, step 1070 may lead to termination when a set number of rounds has been performed, and/or upon observing that log(X(k)) and $C_n$ have converged sufficiently close. In one embodiment, the iterative smoothing may be stopped once 16 rounds have been performed or upon the maximum difference between log(X(k)) and $C_n$ being below 0.23 for all frequency bins (corresponding to a difference in amplitude of approximately 25% in linear units). Advantageously, this allows for the execution time of the smoothing algorithm to be assigned an upper limit, for example to support real-time operation, while still performing as many iterations as feasible within that limit. The upper limit on the number of iterations may be configured to vary depending on a measurement of the resources of the computer system that runs the iterative smoothing process. In an embodiment, step 1070 may adjust its termination criterion based on whether time constraints have been exceeded for past frames; for example, if the latency introduced by the algorithm during any of the past 50 ms of audio has exceed a set threshold, for example more than 10 ms, the termination criterion in step 1070 may be reduced so as to reduce the computational complexity.

If the termination criterion is satisfied, step 1080 is executed. Step 1080 reverses the effect of step 1010 and exponentiates the calculated envelope, interpolating the calculated $C_n$ to match the frequency resolution of the signal and transforming $C_n$ from a logarithmic scale back into linear scale. For example, step 1010 may use linear interpolation. Advantageously, $C_n$ is converted into the magnitude spectral envelope using exponentiation only after finishing the iteration step, thus avoiding performing repeated and unnecessary logarithms and exponentiations of intermediate quantities.

If the termination criterion in step 1070 is not satisfied, another iteration is performed. Step 1090 is executed, incrementing n and returning execution to step 1030.

Advantageously, true envelope estimation provides for a more numerically stable estimation of the spectral envelope as compared to only using other envelope estimation techniques, such as low-pass filtering without subsequent iterative smoothing. Some other envelope estimation techniques may suffer from numerical instability in certain regions of the spectrum, such as below the speaker's fundamental frequency. Advantageously, the true frequency estimation algorithm remains numerically stable above and below the fundamental frequency of the signal, and thus has a decreased tendency to introduce artifacts below the fundamental frequency generated by the speaker's larynx. Accordingly, in some embodiments, dividing out and separately processing parts of the spectrum above and below the fundamental frequency is not necessary to achieve a sufficiently accurate representation of the spectral envelope. Accordingly, no information the speaker's fundamental frequency is necessary to process a voice signal, which allows the system to be more easily used with different speakers.

It will be understood that various calculation steps discussed use mathematical logarithm and exponentiation functions, and that these functions may use any base, for example base e or base 10; however, it may be desirable to consistently use the same base.

It will be understood that it may be advantageous in some embodiments to insert additional elements into the processing paths of FIGS. 8, 9 and 10. Specifically, in certain embodiments, it may be advantageous, for example to reduce computational complexity or to improve numerical stability, to insert normalization, rescaling, subsampling or interpolation steps between, before or after the elements depicted. Similarly, it will be understood that in certain embodiments, some of the elements depicted may not be advantageous. The processing steps depicted in FIGS. 8, 9 and 10 may be implemented, for example, in JavaScript code that is executed by a web browser.

It will also be understood that some of the described steps require input of a certain size, and it may be advantageous to insert additional data before, into or after the input signal to match this required size. In an example implementation, the implementation of the Fourier transform requires the input to be of a certain size, and silence is added before and after the input signal as required to match this required size.

What is claimed is:

1. A computer system, comprising one or more hardware computer processors programmed, via executable code instructions, to:

receive an audio signal representing at least a portion of speech;

split the audio signal into a plurality of overlapping segments;

generate a frequency domain representation of a current signal segment in the plurality of overlapping segments, wherein the frequency domain representation comprises components corresponding to a plurality of frequency bins;

generate, from the frequency domain representation of the current signal segment, a polar representation comprising a magnitude component and a phase component for each of the frequency bins;

generate a refined frequency domain representation of the current signal segment based on a comparison, for each of the frequency bins, between a first phase component from the current signal segment and a second phase component from a prior signal segment;

calculate an initial cepstrum from the refined frequency domain representation;

calculate a spectral envelope from the initial cepstrum using iterative smoothing with a resolution lower than a resolution of the frequency domain representation, wherein the iterative smoothing terminates after a predetermined number of iterations or a predetermined degree of convergence is reached;

calculate an excitation spectrum from the refined frequency domain representation and the spectral envelope;

rescale the spectral envelope based on a formant adjustment parameter to obtain a modified spectral envelope, wherein the spectral envelope is distinct from the current signal segment, the frequency domain representation, and the initial cepstrum;

calculate a modified frequency domain representation by combining the modified spectral envelope and the excitation spectrum;

synthesize a modified signal segment from the modified frequency domain representation; and transmit the modified signal segment over a computer network.

2. The system of claim 1, wherein the one or more hardware computer processors are further programmed, via executable code instructions, to make a pitch adjustment by rescaling the excitation spectrum before the excitation spectrum is combined with the modified spectral envelope.

3. The system of claim 1, wherein the audio signal representing at least a portion of speech is received through a web browser.

4. The system of claim 3 wherein the web browser is configured to receive the audio signal representing a portion of speech via one or more Web Audio API requests.

5. The system of claim 1 wherein the audio signal representing at least a portion of speech is received from a recording device.

6. The system of claim 1 wherein the computer network is the Internet, or is composed of multiple constituent networks.

7. The system of claim 1 wherein the one or more hardware computer processors are further programmed, via executable code instructions, to adjust a relative phase between neighboring frequency bins in the modified frequency domain representation.

8. The system of claim 1, wherein each segment in the plurality of overlapping segments has a duration between 10 milliseconds and 100 milliseconds.

9. The system of claim 1, wherein a percentage of overlap between adjacent segments in the plurality of overlapping segments is greater than 0.5 percent but less than 10 percent of the total duration of each segment in the plurality of overlapping segments.

10. The system of claim 1, wherein the spectral envelope is calculated by low-pass filtering that comprises setting a number of Fourier coefficients in each signal segment to zero, and the number of Fourier coefficients is less than 10 percent of a total quantity of Fourier coefficients in each signal segment but greater than zero.

11. A method for processing digital speech signals in a computer network, the method comprising:

receiving an audio signal representing a portion of speech;

generating a frequency domain representation of a current signal segment in the audio signal, wherein the frequency domain representation comprises components corresponding to a plurality of frequency bins;

calculating an initial cepstrum based at least on the frequency domain representation;

calculating a spectral envelope from the initial cepstrum;

calculating an excitation spectrum from the refined frequency domain representation and the spectral envelope;

adjusting the spectral envelope based on a formant adjustment parameter to obtain a modified spectral envelope, wherein the spectral envelope is distinct from the current signal segment, the frequency domain representation, and the initial cepstrum;

calculating a modified frequency domain representation based on the modified spectral envelope;

synthesizing a modified signal segment from the modified frequency domain representation; and transmitting the modified signal segment over a computer network.

12. The method of claim 11, wherein the method further comprises making a pitch adjustment by rescaling at least one of the excitation spectrum, the spectral envelope, and the frequency domain representation.

13. The method of claim 11 wherein the method further comprises adjusting a relative phase between neighboring frequency bins in the frequency domain representation.

14. The method of claim 11, wherein iterative smoothing is used to calculate the spectral envelope based on the initial cepstrum.

15. The method of claim 14, wherein the iterative smoothing is terminated upon reaching a predetermined number of rounds.

16. The method of claim 14, wherein iterative smoothing is terminated upon reaching a predetermined number of rounds or a predetermined degree of convergence, whichever occurs first.

17. The method of claim 14, wherein the spectral envelope is calculated at a resolution that is lower than a resolution of the frequency domain representation.

18. The method of claim 11, wherein the current signal segment has a duration between 10 milliseconds and 100 milliseconds.

19. The method of claim 11, wherein a percentage of overlap between the current signal segment and an adjacent signal segment is greater than 0.5 percent but less than 10 percent of the total duration of the current signal segment.

20. The method of claim 11, wherein the spectral envelope is calculated by low-pass filtering that comprises setting a number of Fourier coefficients associated with the current signal segment to zero, and the number of Fourier coefficients is less than 10 percent of a total quantity of Fourier coefficients associated with the current signal segment.

* * * * *